US008197290B2

(12) United States Patent
Koyama et al.

(10) Patent No.: US 8,197,290 B2
(45) Date of Patent: Jun. 12, 2012

(54) ELECTRIC CONNECTOR, ELECTRONIC DEVICE, AND ELECTRICALLY-CONDUCTIVE TOUCH METHOD

(75) Inventors: Jiro Koyama, Otsu (JP); Hirotada Teranishi, Kusatsu (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 13/007,488

(22) Filed: Jan. 14, 2011

(65) Prior Publication Data

US 2011/0177726 A1 Jul. 21, 2011

(30) Foreign Application Priority Data

Jan. 15, 2010 (JP) ..... 2010-007134

(51) Int. Cl.
*H01R 4/48* (2006.01)

(52) U.S. Cl. ..... 439/862; 439/474; 439/500

(58) Field of Classification Search ..... 439/862, 439/500, 474

See application file for complete search history.

(56) References Cited

U.S. PATENT DOCUMENTS

| | | | | |
|---|---|---|---|---|
| 4,266,845 | A * | 5/1981 | Ishikawa | 439/862 |
| 4,491,382 | A * | 1/1985 | Ishikawa | 439/839 |
| 6,623,316 | B1 * | 9/2003 | Wu | 439/862 |
| 7,544,107 | B2 * | 6/2009 | Gattuso et al. | 439/862 |
| 2003/0104731 | A1 * | 6/2003 | Chang | 439/862 |
| 2005/0176309 | A1 * | 8/2005 | Soh | 439/862 |
| 2006/0003634 | A1 | 1/2006 | Jeong | |

FOREIGN PATENT DOCUMENTS

| | | |
|---|---|---|
| EP | 1965469 | 9/2008 |
| JP | 2001-237015 | 8/2001 |
| JP | 2003346946 A | 12/2003 |
| JP | 2008-218035 | 9/2008 |
| KR | 10-0662339 | 1/2006 |

OTHER PUBLICATIONS

Mechanical English translation of Japanese patent application with Publication No. 2001-237015, Publication Date: Aug. 31, 2001, 11 pages.

Office Action Issued In Korean Application No. 10-2011-0003759, Dated Feb. 2, 2012 (12 pages With English Translation).

* cited by examiner

*Primary Examiner* — Tho D Ta
(74) *Attorney, Agent, or Firm* — Osha • Liang LLP

(57) ABSTRACT

A compact electric connector in which a contact has a high contact pressure and a large displacement amount is provided. An electric connector includes a contact spring and an auxiliary spring. The contact spring includes a support portion that is supported by a housing, a contact portion that is projected from the housing to abut on the-other-end contact, and a plurality of flexing portions that are bent so as to be deformed between the support portion and the contact portion when the contact portion is pushed into the housing. The auxiliary spring includes a flexing auxiliary portion that abuts on the contact spring to exert an elastic force in a direction in which deformation of the flexing portion closest to the support portion is obstructed when the contact portion of the contact spring is pushed into the housing.

8 Claims, 6 Drawing Sheets

ELECTRIC CONNECTOR, ELECTRONIC DEVICE, AND ELECTRICALLY-CONDUCTIVE TOUCH METHOD

BACKGROUND OF THE INVENTION

1. Technical Field

The present invention relates to an electric connector, an electronic device, and an electrically-conductive touch method.

2. Related Art

Various electric connectors are used in the electronic device. Among others, it is necessary that the electric connector that gets into electrically-conductive touch with an electrode of a battery have a large displacement amount so as to be able to absorb not only a dimension error of the electric connector or a deviation of a mounting position but also a dimension error of a chassis or the battery of the electronic device.

Because occasionally the battery is moved in the chassis of the electronic device, unless a contact pressure of a contact spring is sufficiently increased, there is a possibility of generating temporary blackout in which the electric touch of the contact spring with the electrode of the battery is instantaneously lost. For example, the mobile telephone is powered off when the temporary blackout is generated in a mobile telephone in a standby state, and incoming processing cannot be performed unless the mobile telephone is powered on again.

In the electronic device such as the mobile telephone, there is a demand to reduce dimensions of the electric connector in order to realize the miniaturization of the device. Although the contact spring is shortened when the electric connector is simply miniaturized, a bending deformation amount of the contact spring is increased, and a partially large stress is concentrated. When the applied stress exceeds an elastic limit, the contact spring is plastically deformed to generate so-called wear in which a displacement amount or a contact pressure of the contact is lost. Because the stress concentration is relaxed when the contact spring is thinned, the plastic deformation is hardly generated. However, the elastic force is decreased due to the thinned contact spring, and a contact pressure of the contact is decreased.

For example, Japanese Unexamined Patent Publication No. 2008-218035 discloses a battery connecting electric connector in which the contact spring snakes into a substantial S-shape. However, wear is easily generated when the electric connector is miniaturized.

Japanese Unexamined Patent Publication No. 2001-237015 discloses a contact including two thin spring portions that are extended in parallel in order to fix a displacement direction of the contact, and both ends of the spring portions are connected. In the contact of Japanese Unexamined Patent Publication No. 2001-237015, the contact has a small displacement amount because only the spring portions extended in parallel are elastically deformed. When compared with the case where one thick spring is used, the contact of Japanese Unexamined Patent Publication No. 2001-237015 has no particular advantage with respect to plastic deformation caused by stress concentration.

SUMMARY

One or more embodiments of the present invention provides a compact electric connector and a compact electronic device, in which the contact has the high contact pressure and the large displacement amount, and an electrically-conductive touch method in which an occupied space is reduced.

In accordance with one aspect of the present invention, an electric connector has a contact spring including a support portion that is supported by a housing, a contact portion that is projected from the housing to abut on the-other-end contact, and a plurality of flexing portions that are bent so as to be deformed between the support portion and the contact portion when the contact portion is pushed into the housing, and an auxiliary spring including a flexing auxiliary portion that abuts on the contact spring to exert an elastic force in a direction in which deformation of the flexing portion closest to the support portion is obstructed when the contact portion is pushed into the housing.

With this configuration, the position on which the stress of the contact spring is easily concentrated is assisted by the auxiliary spring, so that the stress generated by the deformation of the contact spring can be dispersed to establish both the high contact pressure and the large displacement amount.

More particularly, generally a stress is concentrated on a neighborhood of a fixed end of a cantilever plate spring when a bending weight acts on the plate spring. For the contact spring in which a plurality of flexing portions are provided, a bending stress is concentrated on each flexing portion, particularly the large bending stress is applied to the flexing portion closest to the support portion. Therefore, the auxiliary spring is provided to assist the flexing portion closest to the support portion, the displacement amount of the flexing portion closest to the support portion is reduced to decrease the stress applied to the flexing portion, and other flexing portions are burdened with the reduced displacement amount. Therefore, the maximum stress applied to the contact spring is reduced without thinning the contact spring, and the plastic deformation of the contact spring can be prevented.

In the electric connector according to one or more embodiments of the present invention, the flexing auxiliary portion may abut on the contact spring while being able to be slid on the contact spring.

With this configuration, the contact spring and the auxiliary spring can be slid on each other, but the contact spring and the auxiliary spring do not act as one spring having a large second moment of area by integrally engaging each other. Therefore, the plastic deformation caused by stress concentration can be prevented.

In the electric connector according to one or more embodiments of the present invention, the auxiliary spring may be integrated with the contact spring at one point.

With this configuration, because the relative positions of the contact spring and auxiliary spring are not deviated, the auxiliary spring properly and securely assists the contact spring.

In the electric connector according to one or more embodiments of the present invention, the auxiliary spring includes a contact auxiliary portion that abuts on a neighborhood of the contact portion of the contact spring when the contact portion is pushed into the housing, and the contact auxiliary portion may exert the elastic force in a direction in which the contact portion is projected from the housing.

With this configuration, the contact portion is projected outward and biased, so that a contact pressure to the-other-end electrode can be enhanced while a load of the whole contact spring is reduced.

In the electric connector according to one or more embodiments of the present invention, the flexing auxiliary portion may abut on the contact spring from behind the contact auxiliary portion when the contact portion is pushed into the housing.

With this configuration, a large effect that reduces the weight applied to the whole contact spring is obtained to secondarily assist the weakest flexing portion of the contact spring, so that the plastic deformation of the contact spring can effectively be prevented.

In the electric connector according to one or more embodiments of the present invention, the flexing auxiliary portion is disposed inside the flexing portion closest to the support portion of the contact spring, and the flexing auxiliary portion is extended in substantially parallel with the flexing portion.

With this configuration, because an outside curved line is longer than an inside curved line in the parallel curved lines, bending moment of the outside curved line becomes stronger than that of the inside curved line, and the outside contact spring is bent larger than the inside contact spring when the contact springs are bent with the same force. Therefore, when the contact springs are formed in parallel during no load, the inside auxiliary spring abuts on the outside auxiliary spring during the deformation, an operation to reduce the load on the flexing portion of the contact spring can easily be realized.

In accordance with another aspect of the present invention, an electronic device includes any of the electric connectors described above, wherein a battery can be mounted, and an electric power is supplied from the battery through the contact spring of the electric connector.

With this configuration, because the electric connector has the high contact reliability with respect to the electrode of the battery, the electric power is securely supplied to the electronic device, and electronic device is securely operated.

In accordance with still another aspect of the present invention, there is provided a method for causing a contact spring to get into electrically-conductive touch with the-other-end electrode, the contact spring including a support portion that is supported by a housing, a contact portion that is projected from the housing to abut on the-other-end contact, and a plurality of flexing portions that are bent so as to be deformed between the support portion and the contact portion when the contact portion is pushed into the housing, wherein deformation of the flexing portion closest to the support portion is relaxed by an auxiliary spring including a flexing auxiliary portion that abuts on the contact spring, when the contact portion is pushed into the housing.

With this configuration, the position on which the stress of the contact spring is easily concentrated is assisted by the auxiliary spring, so that the stress generated by the deformation of the contact spring can be dispersed and both the high contact pressure and the large displacement amount can be established to securely achieve the electrically-conductive touch.

DETAILED DESCRIPTION

Figure 1:
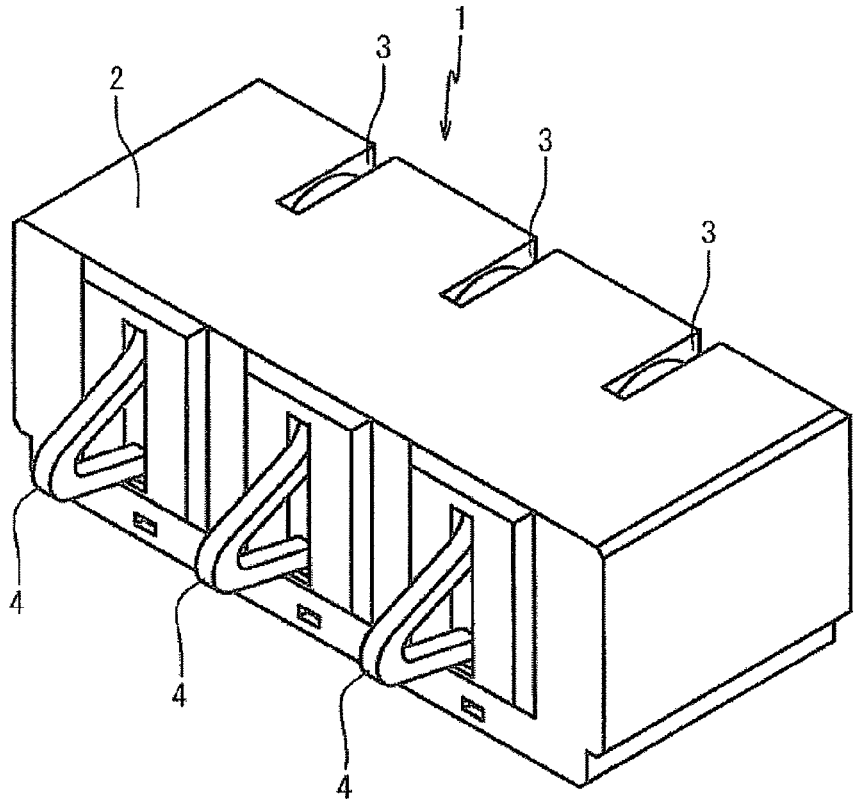
FIG. 1 is a perspective view of an electric connector according to a first embodiment of the present invention.
Figure 2:
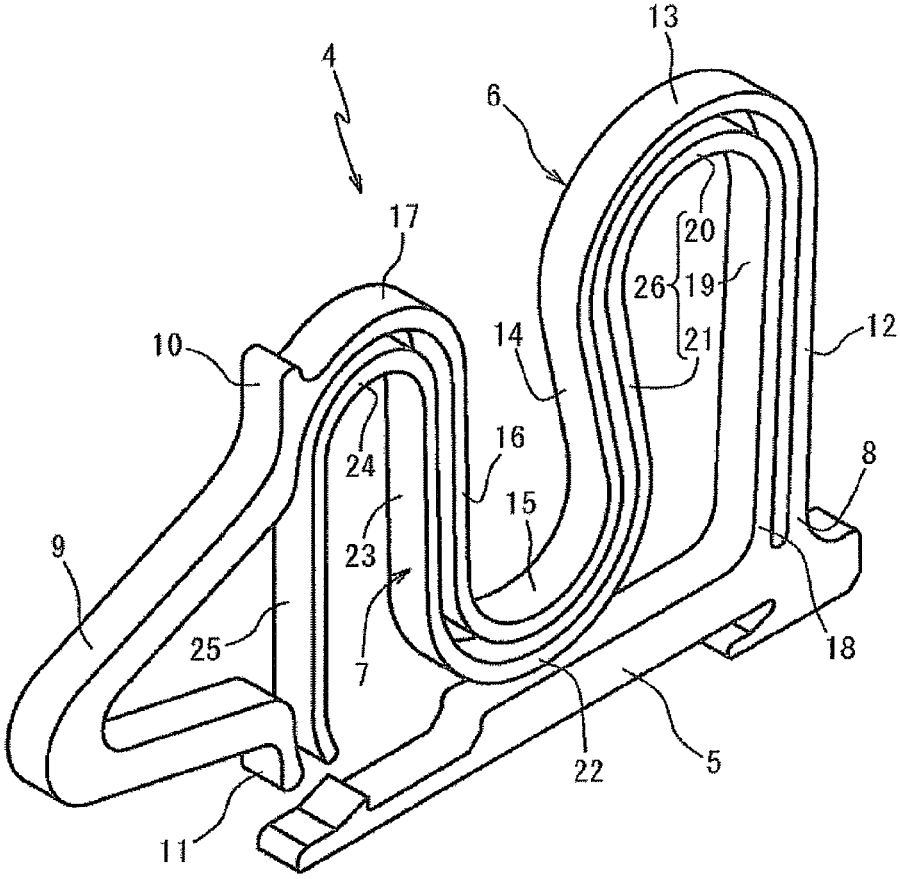
FIG. 2 is a perspective view illustrating a contact member of the electric connector of FIG. 1.

Hereinafter, embodiments of the present invention will be described with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. FIG. 1 illustrates an electric connector 1 according to a first embodiment of the present invention. In the electric connector 1, contact members 4 are inserted in and fixed to three slots 3 formed in a housing 2, respectively.

In the three contact members 4, the central contact member 4 is used as a control contact, and each of the contact members 4 located on both sides is used as a contact that gets into touch with an electrode (the-other-end electrode) of a battery in order to supply a power. When the power supplying contact is formed by a pair of contacts, reliability of electrically-conductive touch with the-other-end electrode is improved.

Figure 3:
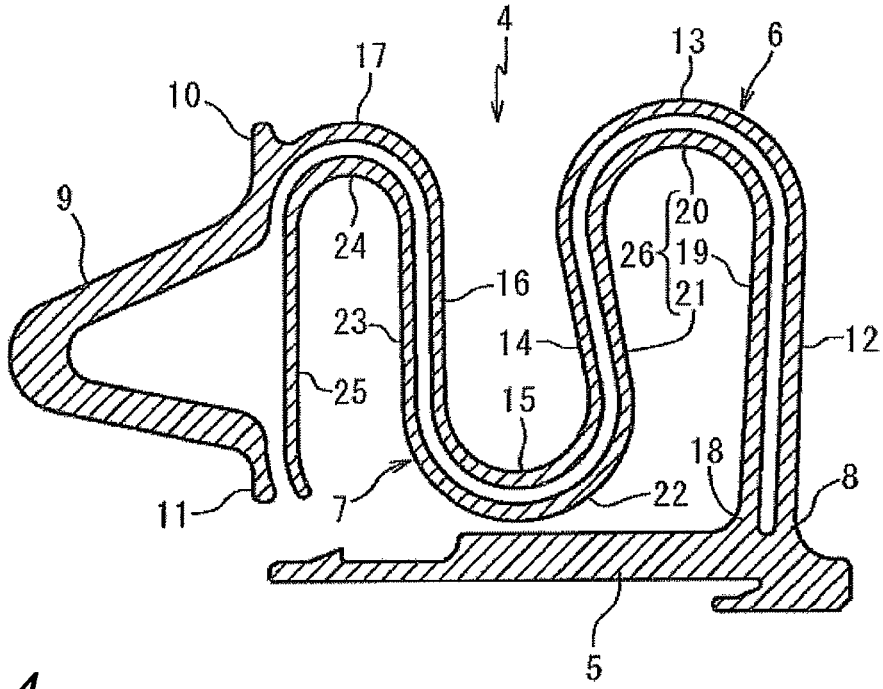
FIG. 3 is a side view of the contact member of FIG. 2.
Figure 4:
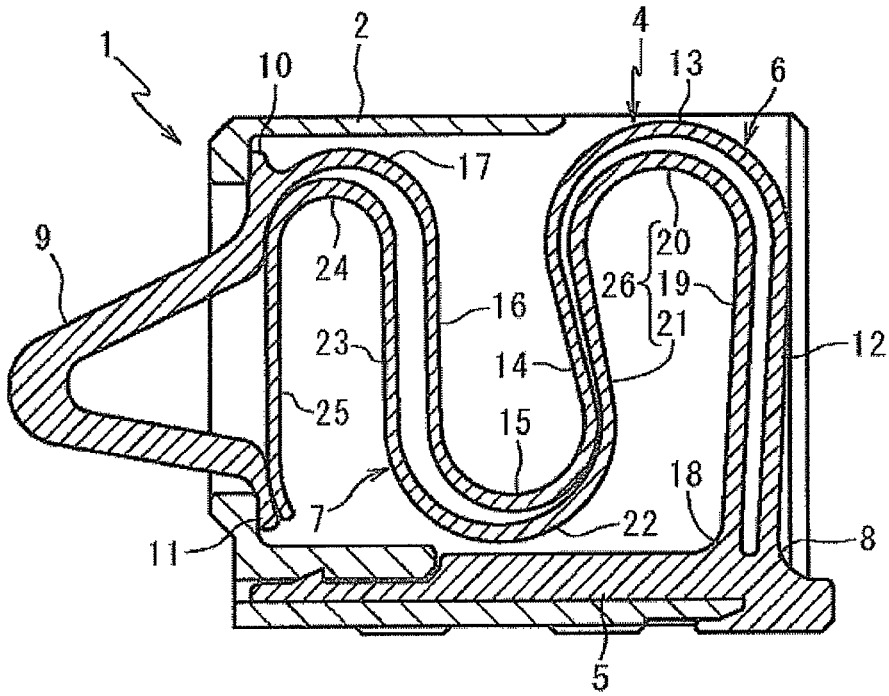
FIG. 4 is a sectional view illustrating an initial state of the electric connector of FIG. 1.
Figure 5:
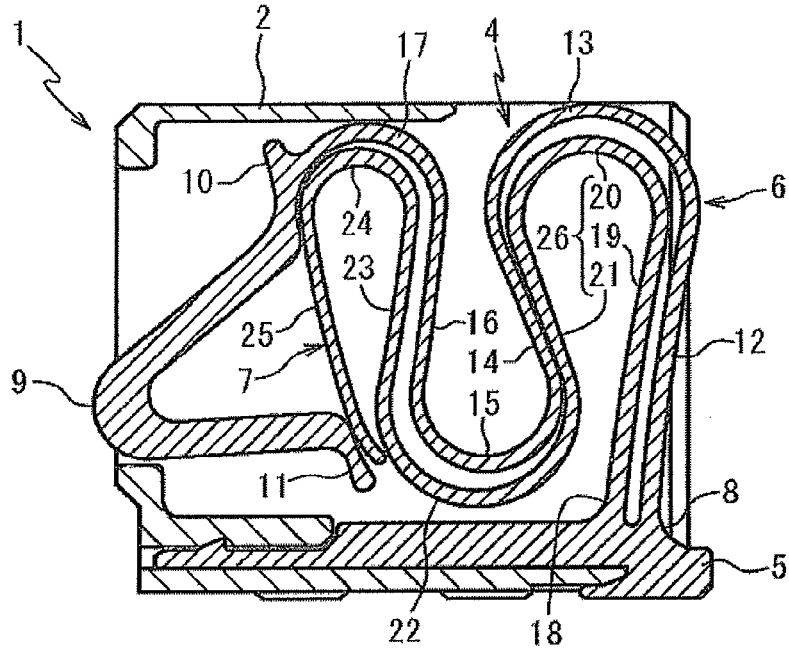
FIG. 5 is a sectional view illustrating a state in which a contact portion of the electric connector of FIG. 1 is pushed into.

FIGS. 2 to 5 illustrate a shape of the contact member 4. FIGS. 3 and 4 illustrate a shape when a stress is not applied to the contact member 4. Particularly FIG. 4 illustrates a state in which the contact member 4 is fixed to the housing 2, and FIG. 5 illustrates a state in which the-other-end electrode is pressed against the contact member 4.

The contact member 4 includes a fixed portion 5, a contact spring 6, and an auxiliary spring 7. The fixed portion 5 is fitted in and fixed to the housing 2, and the contact spring 6 and the auxiliary spring 7 are supported by the fixed portion 5. The contact spring 6 and the auxiliary spring 7 are plate springs in which a depth direction on a paper plane of FIGS. 3 to 5 is set to a plate width.

In the contact spring 6, one end constitutes a support portion 8 that is connected to the fixed portion 5, and the other end constitutes a contact portion 9 that abuts on the-other-end electrode. The support portion 8 is supported by the housing 2 with the fixed portion 5 interposed therebetween, and the support portion 8 is formed while is thickened for the purpose of reinforcement. The contact portion 9 is formed into a chevron shape in which the thickness is sufficiently increased such that the deformation is not generated, and a flexing portion in a central portion of the contact portion 9 is projected to the outside of the housing 2 to abut on the-other-end electrode. As illustrated in FIG. 4, latching portions 10 and 11 are formed at upper and lower ends of the contact portion 9. The latching portions 10 and 11 abut on the housing 2 to retain the contact portion 9 in a state in which the contact portion 9 is slightly pushed into the housing 2.

The contact spring 6 also includes a first arm portion 12, a first flexing portion 13, a second arm portion 14, a second flexing portion 15, a third arm portion 16, and a third flexing portion 17. The first arm portion 12 is extended in a direction orthogonal to the pressing direction of the-other-end electrode from the support portion 8. The first flexing portion 13 is folded back while drawing a semi-circle on the side of the contact portion 9 from the first arm portion 12 with a constant curvature. The second arm portion 14 extended straight from the first flexing portion 13 toward the fixed portion 5. The second flexing portion 15 is folded back while drawing a semi-circle on the side of the contact portion 9 from the second arm portion 14 with a constant curvature. The third arm portion 16 is extended straight from the second flexing portion 15. The third flexing portion 17 is folded back while drawing a semi-circle from the third arm portion 16 with a constant curvature, and the third flexing portion 17 is connected to an upper end of the contact portion 9.

The auxiliary spring 7 is a plate spring, one end of the auxiliary spring 7 is supported by the fixed portion 5, and the auxiliary spring 7 is disposed so as to be extended in substantially parallel with the contact spring 6. More particularly, the auxiliary spring 7 includes a support portion 18, a first arm portion 19, a first flexing portion 20, a second arm portion 21, a second flexing portion 22, a third arm portion 23, a third flexing portion 24, and a contact auxiliary portion 25. The support portion 18 is supported by the fixed portion 5 while being adjacent to the side of the contact portion 9 of the support portion 8 of the contact spring 6. The first arm portion 19 is extended from the support portion 18. The first flexing portion 20 is folded back inside the first flexing portion 13 of the contact spring 6. The second arm portion 21 is extended from the first flexing portion 20. The second flexing portion 22 is folded back outside the second flexing portion 15 of the contact spring 6 from the second arm portion 21. The third arm portion 23 is extended from the second flexing portion 22. The third flexing portion 24 is folded back inside the third flexing portion 17 of the contact spring 6 from the third arm portion 23. The contact auxiliary portion 25 is extended from the third flexing portion 24, and the contact auxiliary portion 25 can abut on upper and lower end portions of the contact portion 9 of the contact spring 6.

Because the support portions 8 and 18 are integrated with the fixed portion 5 interposed therebetween, the contact spring 6 and the auxiliary spring 7 are retained such that the first arm portion 12 of the contact spring 6 and the first arm portion 19 of the auxiliary spring 7 are extended in parallel. As illustrated in FIG. 4, when the contact member 4 is inserted in the housing 2, the latching portions 10 and 11 abut on the housing 2 to compress the contact spring 6, and the contact auxiliary portion 25 of the auxiliary spring 7 abuts on the contact portion 9 of the contact spring 6. When the contact member 4 is further pushed into the housing 2, the auxiliary spring 7 is also compressed along with the contact spring 6.

At this point, in the contact spring 6 and the auxiliary spring 7, the bending stress is easily concentrated on the flexing portions 13, 15, and 17 and 20, 22, and 24, particularly the bending stress is most easily concentrated on the first flexing portions 13 and 20 closest to the support portions 8 and 18. In the first flexing portion 13 of the contact spring 6 and the first flexing portion 20 of the auxiliary spring 7, which are extended so as to draw parallel arcs, the first flexing portion 13 of the contact spring 6 located outside has an extended distance longer than that of the first flexing portion 20 of the auxiliary spring 7. Therefore, bending moment acting on the first flexing portion 13 of the contact spring 6 having a larger acting radius becomes larger than bending moment acting on the first flexing portion 20 of the auxiliary spring 7 having a smaller acting radius. Accordingly, the second arm portion 14 of the contact spring 6 is inclined larger than the second arm portion 21 of the auxiliary spring 7, and the neighborhood of a boundary with the second flexing portion 15 is caused to abut on the auxiliary spring 7.

Therefore, a U-shaped portion (hereinafter referred to as a flexing auxiliary portion 26) including the first arm portion 19, first flexing portion 20, and second arm portion 21 of the auxiliary spring 7 exerts an elastic force in a direction in which the deformation of the first flexing portion 13 of the contact spring 6 is obstructed. As illustrated in FIG. 5, when the contact portion 9 of the contact spring 6 is pressed against the housing 2 by the-other-end electrode, the deformation of the first flexing portion 13 of the contact spring 6, on which the stress is most easily concentrated, is relaxed to be able to prevent the plastic deformation caused by the stress concentration in the first flexing portion 13.

Curvatures of the first flexing portion 13 of the contact spring 6 and the first flexing portion 20 of the auxiliary spring 7 are decreased as the contact portion 9 is pushed into the housing 2. However, because the second arm portion 14 of the contact spring 6 differs from the second arm portion 21 of the auxiliary spring 7 in a moving amount, the second arm portion 14 and the second arm portion 21 are slid such that abutment portions of the second arm portion 14 and the second arm portion 21 are scrubbed each other. Thus, because the contact spring 6 and the auxiliary spring 7 are elastically deformed as independent springs while slid on each other, the contact spring 6 and the auxiliary spring 7 mutually control the deformations, the contact spring 6 and the auxiliary spring 7 do not act as an integral spring having a large second moment of area, and the plastic deformation is not generated by the excessive stress concentration.

In the auxiliary spring 7, because the contact auxiliary portion 25 initially abuts on the contact portion 9 of the contact spring 6, a reaction force is generated by elasticity such that the contact portion 9 is projected from the housing 2. That is, the auxiliary spring 7 enhances the contact pressure of the contact portion 9 of the contact spring 6 to the-other-end electrode by the elastic force. The second arm portion 21 of the auxiliary spring 7 abuts on the contact spring 6 after the auxiliary spring 7 is compressed to some extent, whereby the deformation of the first flexing portion 13 of the contact spring 6 is reduced to evenly apply the stress to the whole of the contact spring 6. The first flexing portion 13 is located closest to the support portion 8, and the stress is easily concentrated on the first flexing portion 13.

When an aspect ratio (ratio of a plate width to a plate thickness) of the sectional shape of each of the contact spring 6 and the auxiliary spring 7 is set double or more, the contact spring 6 and the auxiliary spring 7 are not twisted by the deformation in the plate width direction, and a trouble in which the contact spring 6 and the auxiliary spring 7 are hooked by the housing 2 to disturb the exertion of the elastic force as the spring can be prevented. However, even if the aspect ratios of the contact spring 6 and the auxiliary spring 7 are set to five times or more, the further twist preventing effect is not expected, but only dimensions of the electric connector 1 are enlarged.

Figure 6:
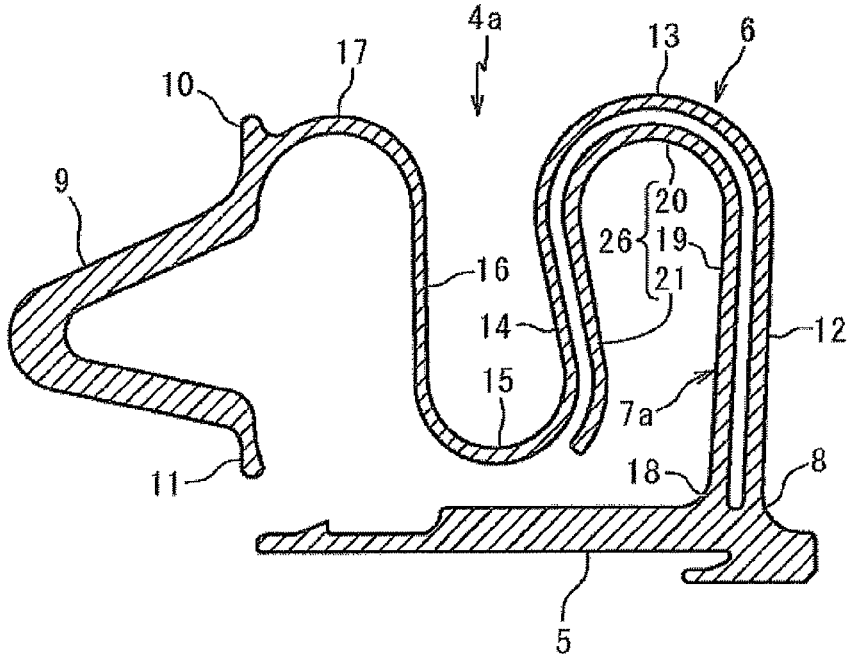
FIG. 6 is a sectional view illustrating a contact member of an electric connector according to a second embodiment of the present invention.

FIG. 6 illustrates a contact member 4*a* of an electric connector according to a second embodiment of the present invention. The contact member 4*a* of the second embodiment includes an auxiliary spring 7*a* in which only the flexing auxiliary portion 26, that is, only the first arm portion 19, the first flexing portion 20, and the second arm portion 21 are extended from the support portion 18. In the second embodiment and the following embodiments, many components including the housing 2 and the like are the same as those of the first embodiment, the same parts as those of the first embodiment are designated by the same reference numerals, and the overlapping description is omitted.

Like the auxiliary spring 7*a* of the contact member 4*a* of the second embodiment, the auxiliary spring according to one or more embodiments of the present invention may include the flexing auxiliary portion 26 that exerts the elastic force so as to obstruct the deformation of at least the portion on which the stress of the contact spring 6 is easily concentrated, that is, the flexing portion 13 closest to the support portion 8.

Figure 7:
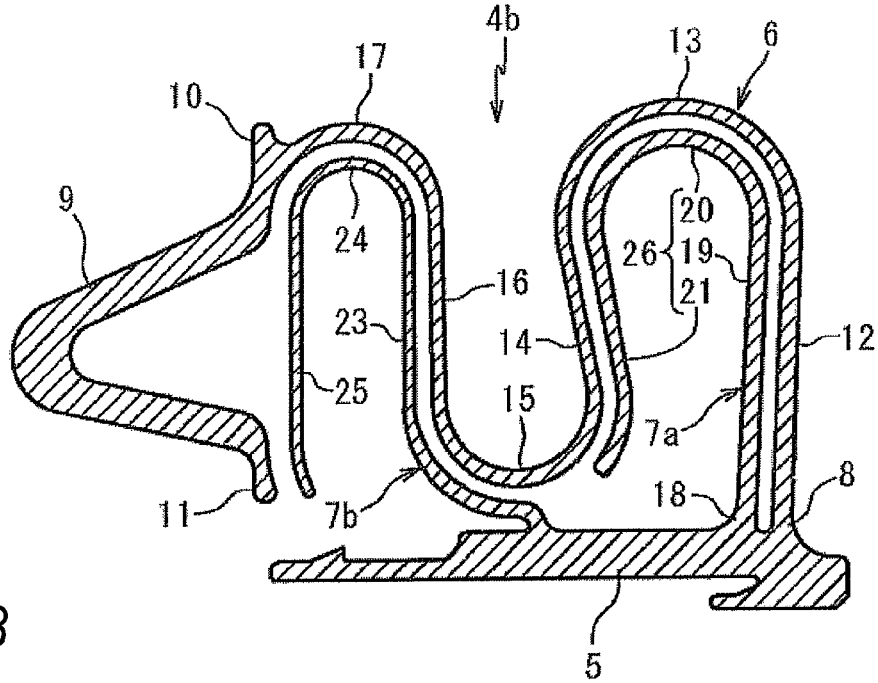
FIG. 7 is a sectional view illustrating a contact member of an electric connector according to a third embodiment of the present invention.

As illustrated in FIG. 7, a contact member 4*b* of an electric connector according to a third embodiment of the present invention may include a second auxiliary spring 7*b* independently of the first auxiliary spring 7*a* including the flexing auxiliary portion 26. The second auxiliary spring 7*b* includes the contact auxiliary portion 25 that abuts on the neighborhood of the contact portion 9 of the contact spring 6, and the second auxiliary spring 7*b* exerts the elastic force in the direction in which the contact portion 9 is projected from the housing 2, thereby enhancing the contact pressure of the contact portion 9 to the-other-end electrode.

The second auxiliary spring 7*b* is formed into the substantially same shape as the leading end portion of the auxiliary spring 7 of the first embodiment. However, because the auxiliary spring 7*b* has a larger strain amount with respect to the deformation amount of the contact spring 6 compared with the auxiliary spring 7 of the first embodiment, the auxiliary spring 7*b* is thinned in order to prevent the plastic deformation caused by the stress concentration.

Figure 8:
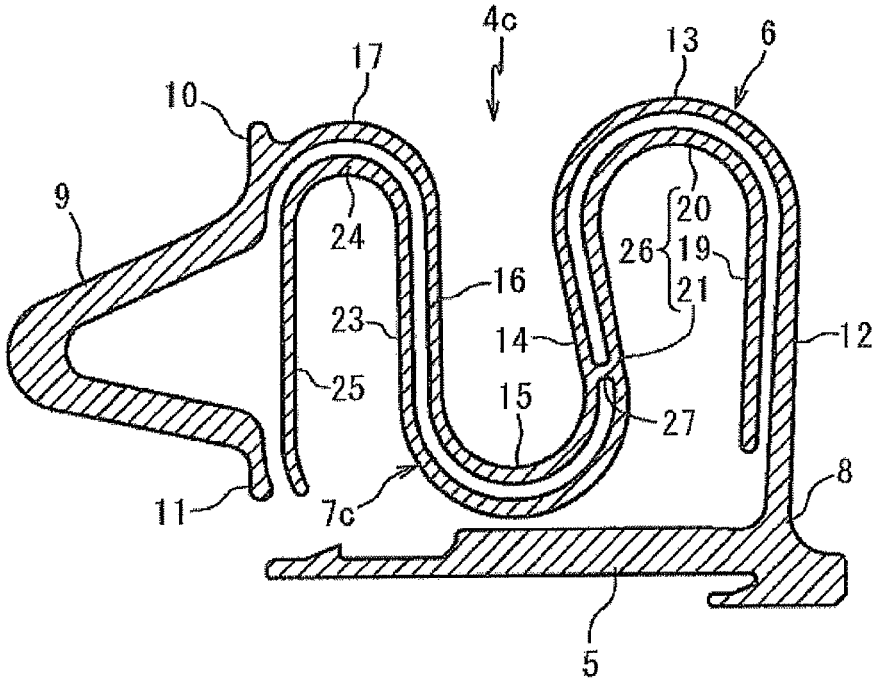
FIG. 8 is a sectional view illustrating a contact member of an electric connector according to a fourth embodiment of the present invention.

FIG. 8 illustrates a contact member 4*c* of an electric connector according to a fourth embodiment of the present invention. In the contact member 4*c*, an auxiliary spring 7*c* is not supported by the fixed portion 5, but the second arm portion 14 of the contact spring 6 and the second arm portion 21 of the auxiliary spring 7*c* is connected by a connection portion 27 and integrally formed. That is, like the auxiliary spring 7*c*, the auxiliary spring according to one or more embodiments of the present invention may be supported by not the fixed portion 5 but the contact spring 6.

In the auxiliary spring 7*c*, when the contact portion 9 is pressed by the-other-end electrode to deform the contact spring 6, the first arm portion 19 serving as the free end abuts on the first arm portion 12 of the contact spring 6 to relax the bend of the first flexing portion 13 of the contact spring 6.

The auxiliary spring 7*c* may be retained by any portion of the contact spring 6 by changing the position of the connection portion 27. However, when the auxiliary spring 7*c* is actually connected to the contact spring 6 at at least two different points, the contact spring 6 and the auxiliary spring 7*c* act as one plate spring having the large second moment of area, and therefore the plastic deformation is generated by the local stress concentration. Accordingly, desirably the auxiliary spring 7*c* is actually integrated with the contact spring 6 only at one point.

In the contact members 4, 4*a*, 4*b*, and 4*c*, the contact spring 6 and the auxiliary springs 7, 7*a*, 7*b*, and 7*c* are integrally formed while the fixed portion 5 or the connection portion 27 is interposed therebetween, so that a positional relationship between the contact spring 6 and the auxiliary springs 7, 7*a*, 7*b*, and 7*c* can strictly be reproduced. However, in one or more embodiments the present invention, the contact spring 6 and the auxiliary springs 7, 7*a*, 7*b*, and 7*c* are formed as separated members, and the contact spring 6 and the auxiliary springs 7, 7*a*, 7*b*, and 7*c* may separately be fixed to the housing 2.

Figure 9:
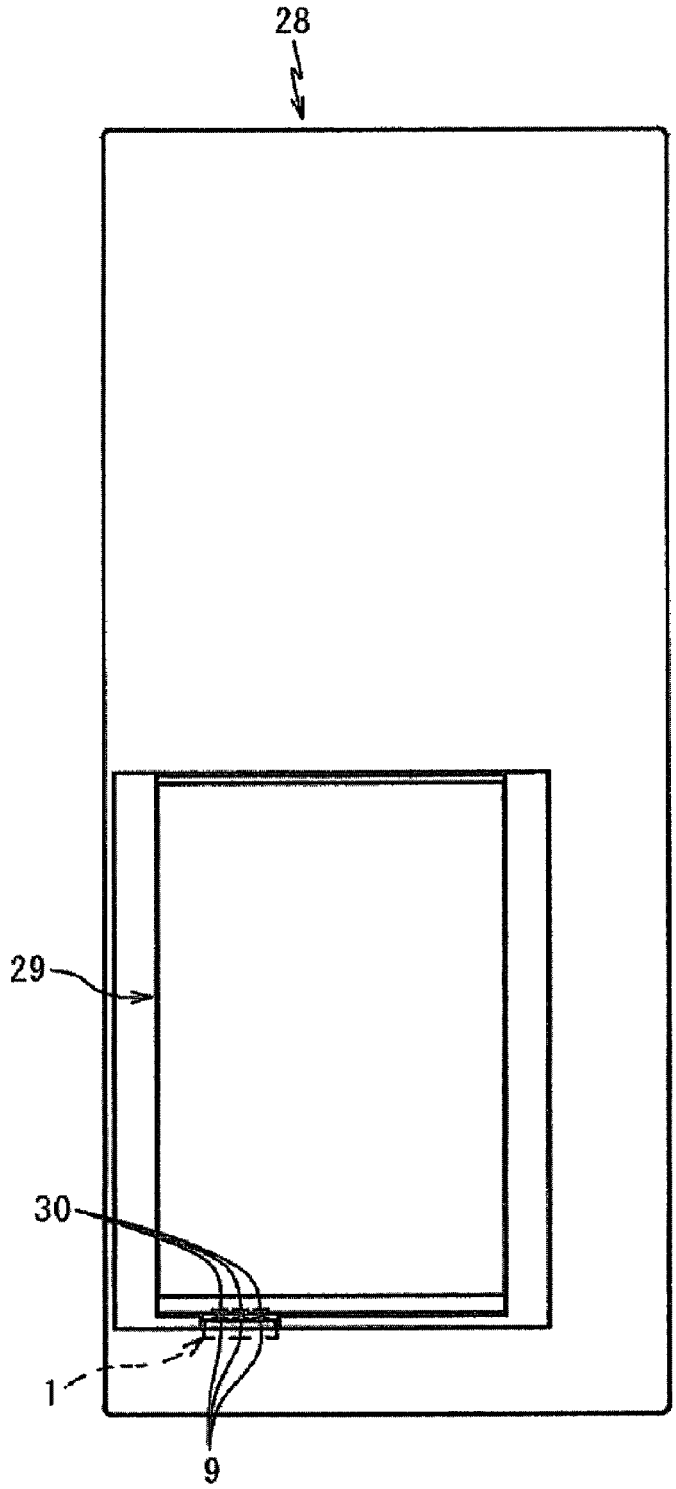
FIG. 9 is a rear view of a mobile telephone according to one or more embodiments of the present invention.

FIG. 9 illustrates a mobile telephone 28 as the electronic device according to an embodiment of the present invention provided with the electric connector 1 of the first embodiment. In the mobile telephone 28, the electric connector 1 is provided, and a battery 29 can be accommodated in a space adjacent to the electric connector 1. When the battery 29 is accommodated in the mobile telephone 28, the contact portion 9 of the electric connector 1 gets into pressure touch with an electrode 30 of the battery 29.

As described above, in the compact electric connector 1, the contact portion 9 has the large deformable amount, the contact pressure is high, and the contact spring 6 is hardly plastically-deformed. Therefore, the electric power is always supplied from the battery 29 to the main body of the mobile telephone 28, so that standby processing and the like can securely be performed.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An electric connector comprising:

a contact spring including:

a support portion that is supported by a housing, a contact portion that is projected from the housing to abut on the-other-end contact, and a plurality of flexing portions that are bent so as to be deformed between the support portion and the contact portion when the contact portion is pushed into the housing; and an auxiliary spring including a flexing auxiliary portion, wherein the contact spring has an initial position and a pushed-in position in which the contact portion is pushed into the housing, wherein, in the initial position, the flexing auxiliary portion is not in contact with the contact spring, and wherein, in the pushed-in position, the flexing auxiliary portion abuts on the contact spring to exert an elastic force in a direction in which deformation of the flexing portion closest to the support portion is obstructed.

2. The electric connector according to claim 1, wherein the flexing auxiliary portion abuts on the contact spring while being able to be slid on the contact spring.

3. The electric connector according to claim 1, wherein the auxiliary spring is integrated with the contact spring at one point.

4. The electric connector according to claim 1, wherein the auxiliary spring includes a contact auxiliary portion that abuts on a neighborhood of the contact portion of the contact spring when the contact portion is pushed into the housing, and the contact auxiliary portion can exert the elastic force in a direction in which the contact portion is projected from the housing.

5. The electric connector according to claim 4, wherein the flexing auxiliary portion abuts on the contact spring from behind the contact auxiliary portion when the contact portion is pushed into the housing.

6. The electric connector according to claim 1, wherein the flexing auxiliary portion is disposed inside the flexing portion closest to the support portion of the contact spring, and the flexing auxiliary portion is extended in substantially parallel with the flexing portion.

7. An electronic device comprising the electric connector according to claim 1, wherein a battery can be mounted, and an electric power is supplied from the battery through the contact spring of the electric connector.

8. A method for causing a contact spring to get into electrically-conductive touch with the-other-end electrode, comprising:

supporting a support portion of the contact spring by a housing;

projecting a contact portion from the housing to abut on the-other-end contact;

bending a plurality of flexing portions so as to be deformed between the support portion and the contact portion when the contact portion is pushed into the housing; and disposing an auxiliary spring including a flexing auxiliary portion and having an initial position and a pushed-in position in which the contact portion is pushed into the housing, wherein the contact spring has an initial position and a pushed-in position in which the contact portion is pushed into the housing, wherein, in the initial position, the flexing auxiliary portion is not in contact with the contact spring, and wherein, in the pushed-in position, the flexing auxiliary portion abuts on the contact spring abuts on the contact spring to exert an elastic force in a direction in which deformation of the flexing portion closest to the support portion is obstructed.

* * * * *